US005823019A

United States Patent [19]

Park

[11] Patent Number: 5,823,019

[45] Date of Patent: Oct. 20, 1998

[54] WASHING MACHINE

[75] Inventor: Kwan-Cheol Park, Kwang-Ju, Rep. of Korea

[73] Assignee: Daewoo Electronics Co., Ltd., Seoul, Rep. of Korea

[21] Appl. No.: 667,596

[22] Filed: Jun. 24, 1996

[30] Foreign Application Priority Data

Jun. 23, 1995 [KR] Rep. of Korea ..... 1995 14510

[51] Int. Cl.[6] ..... D06F 17/10

[52] U.S. Cl. ..... 68/133; 68/134

[58] Field of Search ..... 68/133, 134, 23.3

[56] References Cited

U.S. PATENT DOCUMENTS

| | | | |
|---|---|---|---|
| 1,688,031 | 10/1928 | Altorfer | 68/133 |
| 1,696,718 | 12/1928 | Kuhlmann et al. | 68/133 |
| 1,747,750 | 2/1930 | Beaty | 68/133 |
| 2,441,723 | 5/1948 | Siefert | 68/133 |
| 2,563,046 | 8/1951 | Killin | 68/133 |
| 2,930,216 | 3/1960 | Cazzangia | 68/23.3 |
| 3,026,701 | 3/1962 | Houser et al. | 68/23.3 |
| 3,943,736 | 3/1976 | Carin | 68/134 |
| 4,912,947 | 4/1990 | Dai | 68/134 |

FOREIGN PATENT DOCUMENTS

| | | | |
|---|---|---|---|
| 1222670 | 5/1956 | France | 68/134 |
| 2-31796 | 2/1990 | Japan | 68/133 |
| 10050 | 12/1933 | United Kingdom | 68/134 |
| 534999 | 3/1941 | United Kingdom | 68/134 |
| 113667 | 8/1941 | United Kingdom | 68/133 |

*Primary Examiner*—Frankie L. Stinson
*Attorney, Agent, or Firm*—Beveridge, DeGrandi, Weilacher & Young, LLP

[57] ABSTRACT

Disclosed is a washing machine capable of enhancing washing effectiveness by generating a perpendicular-shaped waterflow. The washing machine has a washing tub for providing space to wash washing articles and a pulsator having a plurality of protrusions formed in a concentric periphery with the washing tub, and for forming a perpendicular-shaped waterflow in washing water by the rotation of the plurality of protrusions. The tangling of the washing articles in the center portion of washing tub is prevented, so that the washing effectiveness is enhanced. The washing effectiveness can be further enhanced because the washing articles strike the plurality of protrusions.

2 Claims, 4 Drawing Sheets

WASHING MACHINE

BACKGROUND OF THE INVENTION

1. Field of the Invention

The present invention relates to a washing machine, more particularly to a washing machine having a pulsator for forming a perpendicular-shaped waterflow to improve washing effect.

2. Prior Arts

In general, a washing machine for home use is a device which can easily remove dirt and other foreign materials contained in washing articles, using washing water and detergents and so on.

Such a washing machine for home use can be classified as a water whirlpool-style washing machine, a water stirring-style washing machine, or a drum-style washing machine by washing methods.

In this case, the water whirlpool-style washing machine is a washing machine which washes washing articles by friction among the washing articles. That is, if a pulsator mounted on the bottom of the washing tub is rotated, a heart-shaped waterflow is generated to cause contact of the washing articles with each other, so that the washing articles are washed.

The water stirring-style washing machine is a washing machine which washes washing articles due to the striking of the washing articles against the washing agitator and the wall of the washing tub. That is, if the washing agitator mounted on the center of the washing tub is regularly rotated, the stirring prominences formed on the outer surface of the washing agitator generates a waterflow so that the washing articles strike against the water agitator and the wall of the washing tub. The washing articles are washed by the striking of the washing articles against the water agitator and the wall of the washing tub.

On the other hand, the drum-style washing machine is a washing machine which washes washing articles by moving the washing articles up and down in a circular motion. The drum-style washing machine has a cylinder-type drum mounted in parallel with the washing tub. The cylinder-type drum includes a plurality of holes and a plurality of prominences. When the cylinder-type drum is rotated, the plurality of prominences move the washing articles up and the moved-up washing articles drop down due to the gravity of the earth. In the way mentioned above the dirt within the washing articles are washed clear. Of the washing machines mentioned above, the water whirlpool-style washing machine is generally used for home use.

The water whirlpool-style washing machine is explained below in detail, referring to FIGS. 1 and 2.

FIG. 1 is a schematic view of a conventional water whirlpool-style washing machine, and FIG. 2 is a schematic view of the pulsator of FIG. 1.

As shown in FIG. 1, a motor 10, which generates a rotating force with an input of external electric power, is mounted on the outer bottom of the washing tub 20. A shaft housing 11 for transmitting the rotating force of motor 10 is connected to the motor 10 through pulleys 12 and a pulley belt 13. A rotating force of shaft housing 11 is transmitted to a pulsator 22 through a shaft 21 of shaft housing 11. Shaft 21 is protruded inside a washing tub 20 through the bottom of washing tub 20. On the upper portion of shaft 21 pulsator 22 is fixed. As shown in FIG. 2, pulsator 22 has a circular-shaped plate 22*a*, and a plurality of wing prominences 22*b* radially formed on the upper surface of circular-shaped plate 22*a*. In such a conventional washing machine, motor 10 is rotated with an input of electric power. The rotation of motor 10 is transmitted to shaft housing 11 to thereby rotate shaft 21. When shaft 21 is rotated, circular-shaped plate 22*a* of pulsator 22 is rotated. Accordingly, the plurality of wing prominences formed on circular-shaped plate 22*a* is rotated. The rotation of the plurality of wing prominences rotates the washing water and the washing articles. That is, the rotation of pulsator 22 generates a centrifugal force of the washing water, and the centrifugal force move the outer periphery portion of the washing water upwards while moving the inner portion of the washing water downwards. Therefore, a heart-type waterflow is formed in the washing water. Such a heart-type waterflow causes the washing articles to make contact with each other so as to remove the dirt of the washing articles.

In the washing of washing articles by the heart-type waterflow, the washing articles in the center portion of the heart-type waterflow become tangled with each other to thereby deteriorate the effectiveness of the washing. Further, the washing of washing articles is performed by friction between the washing articles as well as by friction between the washing articles and the inner wall of the washing tub 20. Since the washing articles move in accordance with the heart-type waterflow, the washing articles in the center portion of the heart-type waterflow are not sufficiently washed.

SUMMARY OF THE INVENTION

Accordingly, it is an object of the present invention to provide a washing machine having a pulsator capable of generating a perpendicular-shaped waterflow to thereby enhance washing effectiveness.

In order to achieve the object, a washing machine according to an embodiment of the present invention comprises a washing tub for providing space to wash washing articles, a motor for rotating a shaft protruded inside the washing tub, and a pulsator having a plurality of wing protrusions to form a perpendicular-shaped waterflow in washing water by the rotation of the shaft.

According to the embodiment of the present invention, a rotation of the motor is transmitted to the shaft in order for the shaft to be rotated. The rotation of the shaft causes the pulsator to be rotated to thereby generate the perpendicular-shaped waterflow in the washing water which has been supplied in the washing tub. The perpendicular-shaped waterflow washes out the dirt from the washing articles and prevents the washing articles from tangling with each other unlike the washing of the heart-shaped waterflow so that the washing effectiveness for the washing articles can be enhanced.

BRIEF DESCRIPTION OF THE DRAWINGS

The above object, and other features and advantages of the present invention will be apparent by describing the preferred embodiment of the present invention hereinafter with reference to the accompanying drawings in which.

DESCRIPTION OF THE PREFERRED EMBODIMENTS

The preferred embodiment of the present invention will be described below in detail with reference to the accompanying drawings.

Figure 1:
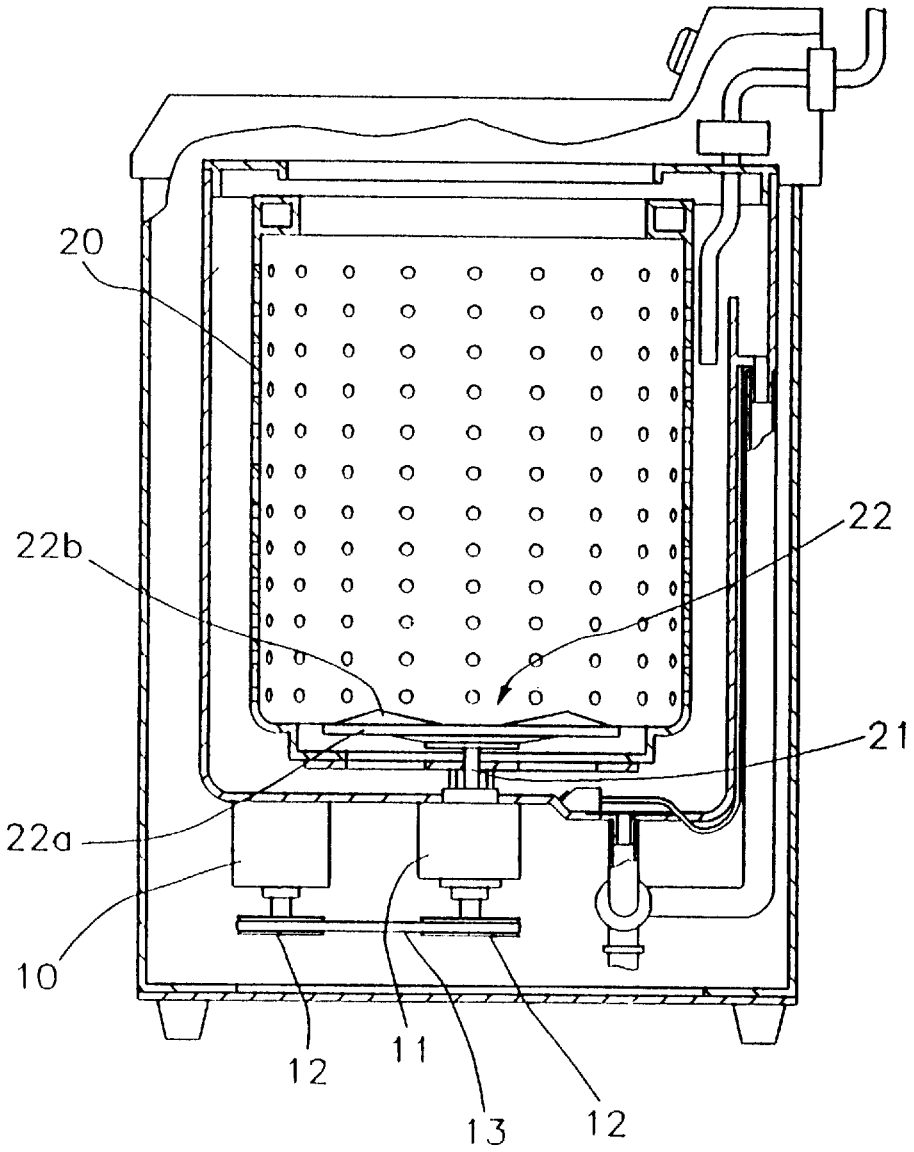
FIG. 1 PRIOR ART
FIG. 1 is a schematic view for a conventional water whirlpool-style washing machine.
Figure 2:
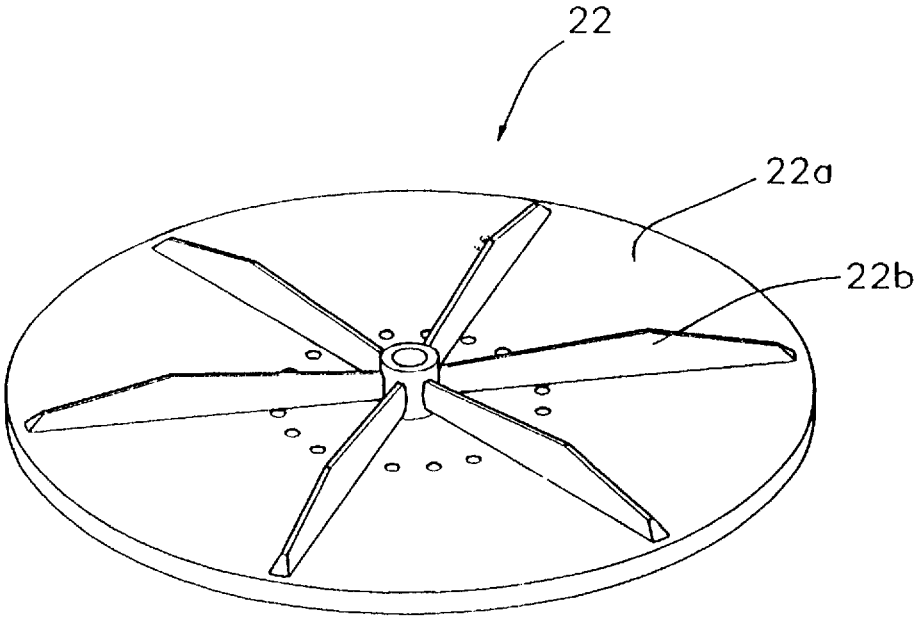
FIG. 2 PRIOR ART
FIG. 2 is a schematic view for the pulsator of FIG. 1.
Figure 3:
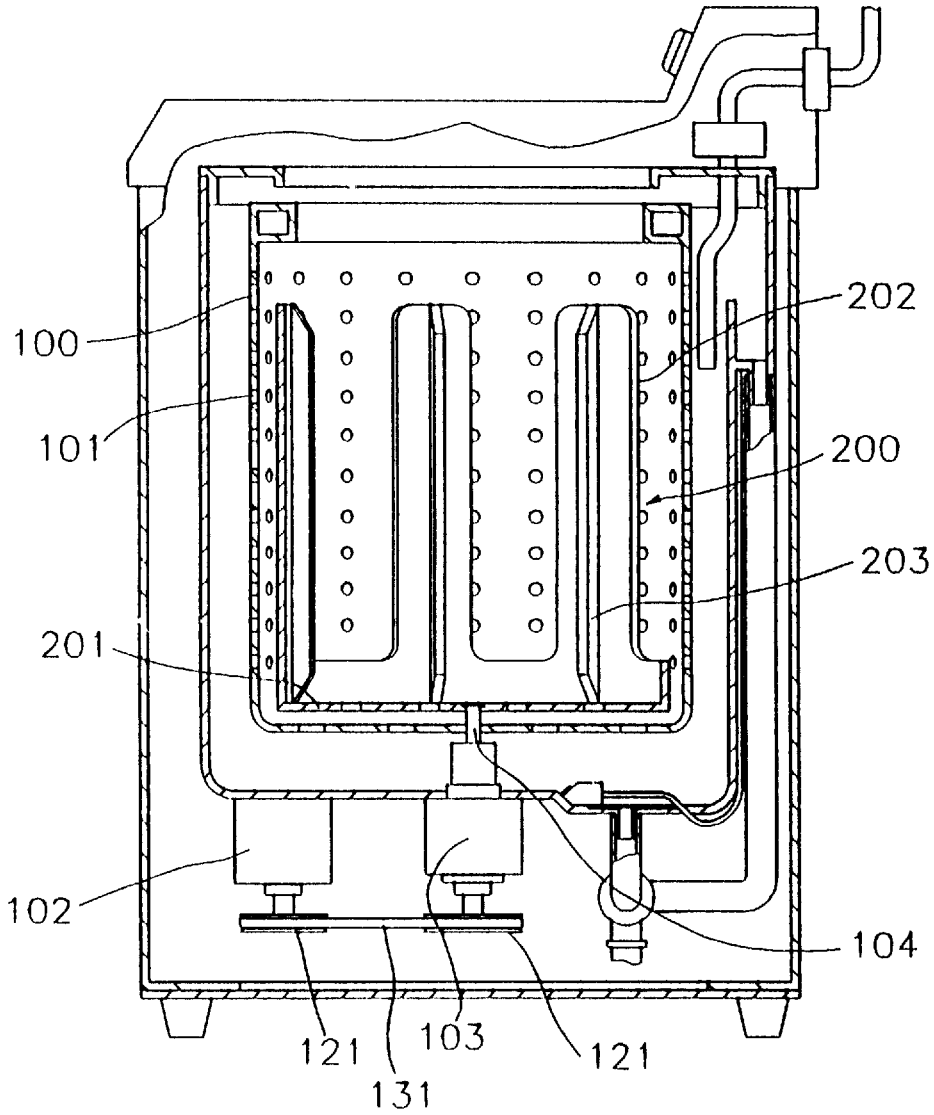
FIG. 3 is a schematic view for a washing machine according to an embodiment of the present invention.
Figure 4:
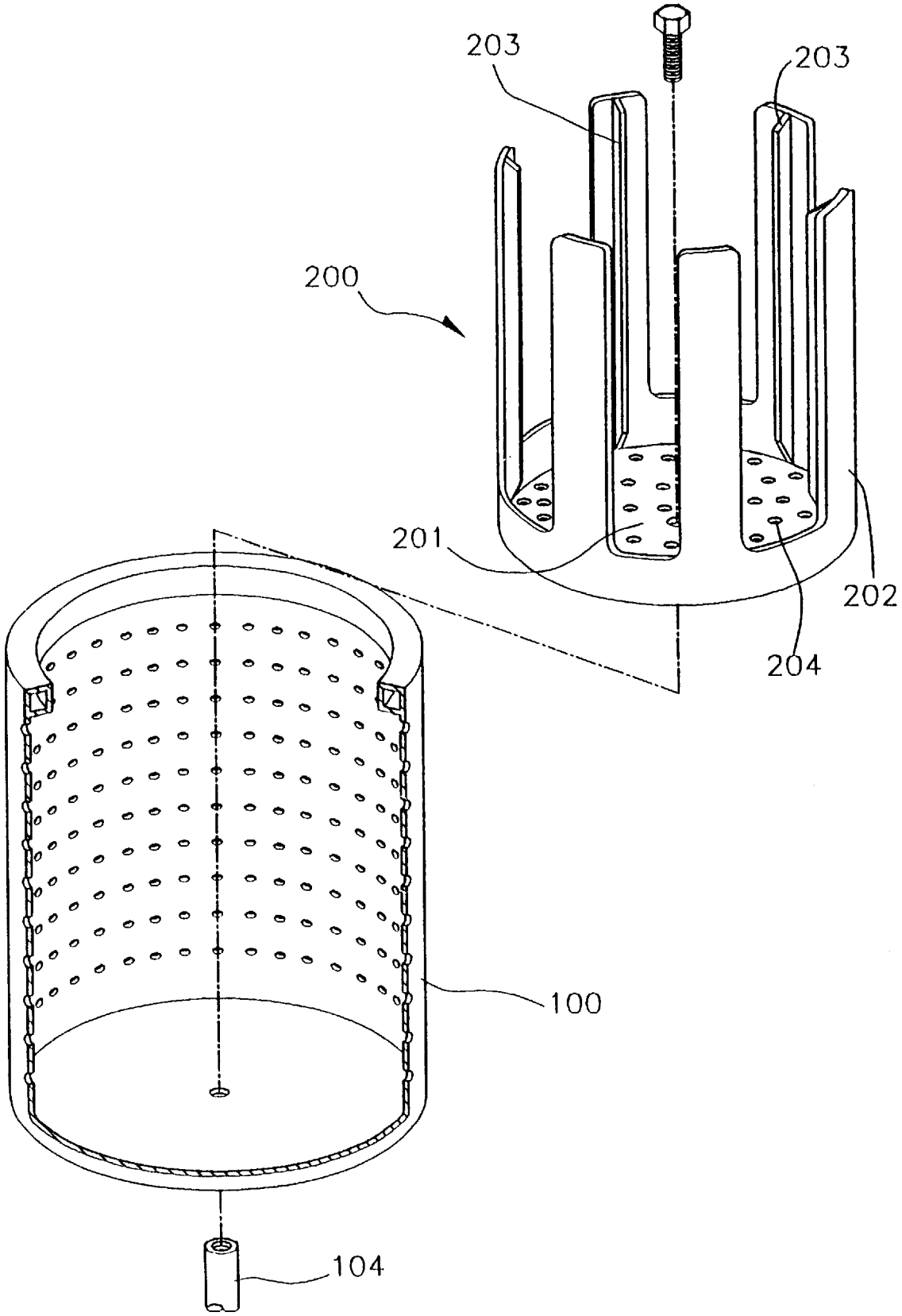
FIG. 4 is a view for showing the pulsator of FIG. 3.

FIG. 3 is a schematic view for a washing machine according to an embodiment of the present invention, and FIG. 4 is a view for showing the pulsator of FIG. 3 in detail. As shown in FIGS. 3 and 4, a washing tub 100 has a plurality of holes 101. One side of a motor 102 is mounted on the outer bottom of washing tub 100, and motor 102 is operated with an input of external electric power. The other side of motor 102 is connected with one side of a shaft housing 103 to receive a rotation force of motor 102 through pulleys 121 and a pulley belt 131. The other side of shaft housing 103 has a shaft 104 to be rotated by the rotation force transmitted from shaft housing 103, and shaft 104 is protruded into the inside of washing tub 100. Shaft 104 is fixed to a pulsator 200. pulsator 200 has a disc-shaped base plate 201, a plurality of supporting members 202 perpendicularly formed along the outer periphery of disc-shaped base plate 201 for being rotated according to the rotation of disc-shaped base plate 201, and a plurality of protrusions 203 longitudinally mounted on the inner surface of the plurality of supporting members 202 for forming a perpendicular-shaped waterflow when the plurality of supporting members 202 are rotated. Further, the plurality of supporting members 202 is spaced apart at a certain distance therebetween. The plurality of supporting members 202 is each formed in an arc-shaped plate. The arc shape is caused by the formation of the plate along the outer periphery of disc-shaped base plate 201. Disc-shaped base plate 201 is fixed to shaft 104 and has a plurality of holes 204 to let washing water in and out of washing tub 100. The plurality of supporting members 202 is integrally formed with disc-shaped base plate 201 and along the outer periphery of disc-shaped base plate 201, and extended nearly up to the upper end of washing tub 100 in order to support the plurality of protrusions 203 longitudinally. The plurality of protrusions 203 are illustrated in a rectangular-bar shape in the embodiment of the present invention, but they may be in a conical shape or in a combinational shape of a cone and a rectangular bar.

As shown in FIG. 4, motor 102, which generates a rotating force with an input of external electric power, is mounted on the outer bottom of the washing tub 100. A shaft housing 103 is connected to motor 102 through pulleys 121 and a pulley belt 131 so as to transmit the rotating force of motor 102. A rotating force of shaft housing 103 is transmitted to a pulsator 200 through a shaft 104 of shaft housing 103. Shaft 104 is protruded inside a washing tub 100 through the bottom of washing tub 100. On the upper portion of shaft 104 the disc-shaped base plate 201 of pulsator 200 is fixed. In the embodiment of the present invention memtioned above, motor 102 is rotated with an input of external electric power. The rotation of motor 102 is transmitted to shaft 104 which is protruded through shaft housing 103 into the bottom of washing tub 100. Therefore, shaft 104 is rotated. The rotation of shaft 104 causes pulsator 200 to be rotated. By the rotation of pulsator 200, the plurality of protrusions 203, which are perpendicularly formed with disc-shaped base plate 201 and along the outer periphery of disc-shaped base plate 201, push washing water toward the center portion of washing tub 100, so that the washing water in the center portion of washing tub 100, that is, the washing water inside pulsator 200, rises. The risen washing water descends along the wall of washing tub 100 due to gravity, so that a perpendicular-shaped waterflow is formed. Washing articles move according to the waterflow of the washing water and the washing articles are washed due to friction with the plurality of protrusions 203. Therefore, the tangling of the washing articles in the center portion of washing tub 100 is prevented since the heart-shaped waterflow hardly occurs. Accordingly, the washing effectiveness is enhanced. The washing effectiveness can be further enhanced because the washing articles strike the plurality of protrusions.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A washing machine for washing washing articles by a rotation of a pulsator according to rotating a shaft of a shaft housing, comprising:

a washing tub for providing space to wash washing articles and having a plurality of holes; and the pulsator having:

a disc-shaped base plate having a plurality of holes to let washing water in and out of the washing tub and fixed to the shaft so as to be rotated according to the rotation of the shaft;

a plurality of supporting members perpendicularly formed along and integrally formed with the outer periphery of the disc-shaped base plate for being rotated by the rotation of the disc-shaped base plate, and spaced apart at a certain distance therebetween, and extended nearly up to the upper end of the washing tub; and a plurality of protrusions formed in a concentric periphery with the washing tub and longitudinally formed on an inner surface of the plurality of supporting members respectively, and for forming a perpendicular-shaped waterflow in washing water when the plurality of supporting members are rotated and for enhancing a washing effectiveness by striking the washing articles against the plurality of protrusions and the plurality of supporting members, wherein the plurality of protrusions are rotated according to the rotation of the shaft.

2. The washing machine as claimed in claim 1, wherein each of the plurality of protrusions is formed in a rectangular bar shape.

* * * * *